US010520286B2

(12) United States Patent
Loehken et al.

(10) Patent No.: US 10,520,286 B2
(45) Date of Patent: Dec. 31, 2019

(54) INLAY FOR SHAPED CHARGE AND METHOD OF USE

(71) Applicant: DynaEnergetics GmbH & Co. KG, Troisdorf (DE)

(72) Inventors: Joern Olaf Loehken, Troisdorf (DE); Denis Will, Troisdorf (DE); Bernd Fricke, Hannover (DE)

(73) Assignee: DynaEnergetics GmbH & Co. KG, Troisdorf (DE)

( * ) Notice: Subject to any disclaimer, the term of this patent is extended or adjusted under 35 U.S.C. 154(b) by 0 days.

(21) Appl. No.: 16/002,217

(22) Filed: Jun. 7, 2018

(65) Prior Publication Data

US 2019/0310056 A1 Oct. 10, 2019

Related U.S. Application Data

(60) Provisional application No. 62/654,306, filed on Apr. 6, 2018.

(51) Int. Cl.
*F42B 1/028* (2006.01)
*F42B 3/08* (2006.01)
(Continued)

(52) U.S. Cl.
CPC ..... *F42B 1/028* (2013.01); *E21B 43/117* (2013.01); *F42B 1/02* (2013.01); *F42B 3/08* (2013.01)

(58) Field of Classification Search
CPC .. F42B 1/02; F42B 1/024; F42B 1/028; F42B 1/032; F42B 1/036; F42B 3/08;
(Continued)

(56) References Cited

U.S. PATENT DOCUMENTS 4,063,512 A * 12/1977 Davis ..... F42B 1/028 102/476
4,702,171 A * 10/1987 Tal ..... F42B 1/032 102/476
(Continued)

FOREIGN PATENT DOCUMENTS

EP 0184622 A2 * 6/1986 ..... F42B 3/08
EP 0773425 A1 * 5/1997 ..... F42B 1/028
(Continued)

OTHER PUBLICATIONS

Waters & Wang, The Impact of Geomechanics and Perforation on Hydraulic Fracture Initiation & Complexity in Horizontal Well Completions, Sep. 26-28, 2016, SPE-181684-MS, 36 pg.
(Continued)

*Primary Examiner* — James S Bergin
(74) *Attorney, Agent, or Firm* — Moyles IP, LLC

(57) ABSTRACT

According to some embodiments, a shaped charge inlay may include an upper edge that extends inward and horizontal to an edge of a shaped charge casing associated with a shaped charge. The shaped charge includes an existing liner and the shaped charge inlay further includes a body that extends inward toward an apex of the existing liner. The shaped charge inlay may be disposed above the existing liner in the shaped charge, to disrupt collapse of the existing liner upon detonation of the shaped charge and thereby change the geometry of a perforating jet and resulting perforation created by the shaped charge.

17 Claims, 14 Drawing Sheets

(51) Int. Cl.
*F42B 1/02* (2006.01)
*E21B 43/117* (2006.01)

(58) Field of Classification Search
CPC ..... F42B 12/10; F42B 12/105; F42B 12/12; F42B 12/14; F42B 12/16; F42B 12/18; E21B 43/117; E21B 43/119
USPC ..... 102/306, 308, 309, 310, 476, 307
See application file for complete search history.

(56) References Cited

U.S. PATENT DOCUMENTS

| | | | | |
|---|---|---|---|---|
| 4,862,804 | A | 9/1989 | Chawla et al. | |
| 5,565,644 | A | 10/1996 | Chawla | |
| 5,753,850 | A | 5/1998 | Chawla et al. | |
| 6,510,796 | B2 | 1/2003 | Mayseless et al. | |
| 7,712,416 | B2 | 5/2010 | Pratt et al. | |
| 7,789,153 | B2 | 9/2010 | Prinz et al. | |
| 7,987,911 | B2 | 8/2011 | Rhodes et al. | |
| 8,156,871 | B2 | 4/2012 | Behrmann et al. | |
| 8,418,622 | B1 * | 4/2013 | Pham | F42B 12/10 102/306 |
| 8,505,454 | B2 * | 8/2013 | Boyer | F42B 1/028 102/306 |
| 9,612,093 | B2 | 4/2017 | Collier et al. | |
| 9,702,669 | B1 | 7/2017 | Powell | |
| 2001/0052303 | A1 | 12/2001 | Mayseless et al. | |
| 2003/0183113 | A1 | 10/2003 | Barlow et al. | |
| 2009/0050321 | A1 | 2/2009 | Rhodes et al. | |
| 2011/0155013 | A1 | 6/2011 | Boyer et al. | |
| 2015/0316360 | A1 | 11/2015 | Hinton et al. | |
| 2016/0153267 | A1 | 6/2016 | Walker et al. | |
| 2016/0349021 | A1 | 12/2016 | Collier et al. | |
| 2018/0094910 | A1 | 4/2018 | Montoya Ashton et al. | |

FOREIGN PATENT DOCUMENTS

| | | | |
|---|---|---|---|
| GB | 2303687 | A | 2/1997 |
| WO | WO-2005103602 | A1 | 11/2005 |

OTHER PUBLICATIONS

Stephen Rassenfoss, Rethinking Fracturing at the Point of Attack, Apr. 1, 2018, 6 pgs, https://www.spe.org/en/print-article/?art=4007.
Andy Martin & Harvey Williams, Fracture Initiation from Perforations, presentation at Schlumberger, IPS-14-02, May 12, 2014, 33 pgs.
International Search Report and Written Opinion of International App. No. PCT/EP2019/054442, dated May 21, 2109, which is in the same family as U.S. Appl. No. 16/002,217, 14 pgs.

* cited by examiner

INLAY FOR SHAPED CHARGE AND METHOD OF USE

CROSS-REFERENCE TO RELATED APPLICATIONS

This application claims the benefit of U.S. Provisional Application No. 62/654,306 filed Apr. 6, 2018, which is incorporated herein by reference in its entirety.

FIELD OF THE DISCLOSURE

Devices, systems, and methods for perforating, among other things, wellbore structures and oil and gas deposit formations are generally disclosed. More specifically, devices, systems, and methods for adapting a geometry of a perforating jet and resulting perforation are disclosed.

BACKGROUND OF THE DISCLOSURE

Perforating gun assemblies are used in many oilfield and gas well completions. In particular, the assemblies may be used for, among other things, any or all of generating holes in downhole pipe/tubing (such as a steel casing) to gain access to an oil/gas deposit formation and to create flow paths for fluids used to clean and/or seal off a well, and perforating the oil/gas deposit formation to liberate the oil/gas from the formation. The perforating gun assemblies are usually cylindrical and include a detonating cord arranged within the interior of the assembly and connected to shaped charges, hollow charges or perforators disposed therein. Shaped charges are explosive components configured to focus ballistic energy onto a target. When the detonating cord initiates the explosive within the shaped charge, a liner and/or other materials within the shaped charge are collapsed and propelled out of the shaped charge in a perforating jet of thermal energy and solid material. The shaped charges may be designed such that the physical force, heat, and/or pressure of the perforating jet, expelled materials, and shaped charge explosion will perforate, among other things, steel, concrete, and geological formations.

Shaped charges for perforating guns used in wellbore operations come in many shapes/geometries. For example, shaped charges typically may be hemispherical, conical, frustoconical, or rectangular. The shape of the shaped charge in part determines the geometry of the perforating jet and/or perforation (hole) that is produced by the charge upon detonation. Hemispherical, conical, and frustoconical shaped charges (collectively, conical shaped charges or rotational symmetric shaped charges) tend to produce round/(semi-)circular perforations, while rectangular, or "slotted", shaped charges tend to produce rectangular and/or linear perforations ("slots"). Particular geometries may be useful for specific applications in wellbore operations. For example, conical charges may produce a concentrated perforating jet that penetrates deep into a geological formation, to enhance access to oil/gas formations. Slotted shaped charges may produce linear perforations that can overlap each other in a helical pattern, and thereby perforate a cylindrical target around all 360° of the target. Such a pattern may be useful during abandonment of a well, where concrete is pumped into the well and must reach and seal substantially all areas of the wellbore.

One disadvantage of typical shaped charges is that the geometry of the shaped charge and associated perforating jet is set when the shaped charge is manufactured according to corresponding specifications. As such, a particularly-styled shaped charge must be kept on hand for each respective application in which a particular shaped charge is used. The limited, particularized use of different shaped charges thereby increases the costs and efforts associated with, e.g., manufacturing smaller batches of shaped charges, holding inventory of specific shaped charges, and transporting and keeping various styles of shaped charges at a job site.

Based at least on the above considerations, devices, systems, and methods for changing the perforation geometry of a shaped charge would provide economic and logistical benefits. For example, a standard charge may be adapted to produce a variety of perforation geometries, thus saving on manufacturing costs for customizing shaped charges and obviating the need to keep a variety of shaped charges at a wellbore location. These and other benefits are further served by devices, systems, and associated methods that are economical, adaptable to a variety of shaped charges and applications, and simple to execute.

BRIEF DESCRIPTION OF THE EXEMPLARY EMBODIMENTS

Some exemplary embodiments described herein relate to a shaped charge inlay for use with a liner in a shaped charge. The shaped charge inlay is secured to the liner, and includes an upper edge, and a distal edge opposite the upper edge. The upper edge may extend inwardly from an edge of a shaped charge case associated with a shaped charge. The shaped charge inlay further includes a body that extends between the upper and distal edges, and toward an apex of the liner. According to an aspect, at least a portion of the shaped charge inlay covers a portion of the liner that is away from the apex of the liner. The shaped charge inlay is disposed above the liner in the shaped charge in a manner that disrupts the collapse of the liner upon detonation of the shaped charge, thereby changing the geometry of a perforating jet and/or perforation created by the shaped charge. The shaped charge inlay adapts shaped charges so that the shaped charge can be used to create atypical perforation hole geometries, regardless of the shape of the case of the shaped charge. The atypical hole geometries are different than the standard perforating hole geometry that would be formed in the absence of the shaped charge inlay.

The present disclosure further describes a shaped charge inlay including a continuous ring and a plurality of fingers extending from the continuous ring. The fingers are arranged in a manner that forms an open apex opposite the continuous ring. The shaped charge inlay is particularly suited for use with a liner in a shaped charge, and is configured to transform a perforating jet to create atypical perforating hole geometries. According to an aspect, the atypical perforation hole geometries are based in part on the quantity/number of the fingers.

According to an aspect, the shaped charge inlays described hereinabove are particularly suited for use in shaped charges. Such shaped charges include a case having a hollow interior, an explosive load disposed within the hollow interior, and a liner disposed adjacent the explosive load. A shaped charge inlay, substantially as described hereinabove, is disposed adjacent the liner so that upon detonation of the shaped charge, an atypical perforation hole is formed.

The present embodiments also relate to a method of changing a perforating jet geometry of a shaped charge. The method includes securing a shaped charge inlay in a shaped charge. The inlay and the shaped charge may be substantially as described hereinabove. The shaped charge inlay may be coupled or otherwise secured to the shaped charge. The method further includes detonating the shaped charge to form a perforating jet that produces an atypical perforation hole geometry in a target or formation.

In various exemplary embodiments, the disclosed devices, systems, and methods may result in perforation geometries that are, e.g., rectangularly-shaped, triangularly-shaped, cross-shaped, star-shaped, and the like.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1A:
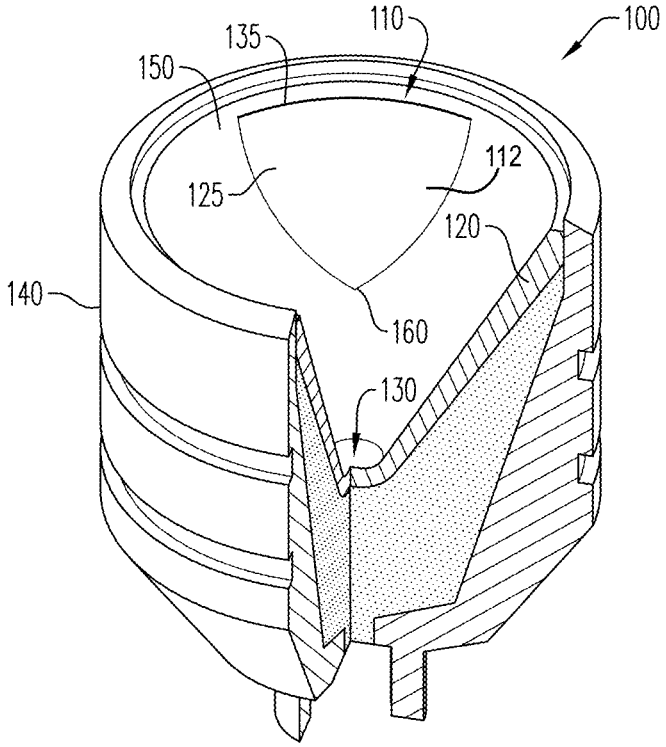
FIG. 1A is a perspective view of a conical shaped charge including a shaped charge inlay, in accordance with an exemplary embodiment.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation, and is not meant as a limitation and does not constitute a definition of all possible embodiments.

For purposes of this disclosure, the phrases "device(s)", "system(s)", and "method(s)" may be used either individually or in any combination referring without limitation to disclosed components, grouping, arrangements, steps, functions, or processes.

The exemplary embodiments relate generally to a shaped charge inlay that is coupled to an existing liner of a shaped charge, to change a particular geometry of a perforating jet and/or perforation produced by the shaped charge. For example, the shaped charge inlay may be coupled to the existing liner of a conical shaped charge so that detonation of the conical shaped charge causes a rectangularly-shaped perforation and/or linear slots instead of a round/circular perforation. The shaped charge inlays described herein may change a shape of the perforation produced by the perforating jet and may not necessarily affect a size of the perforation hole.

For purposes of illustrating features of the embodiments, a simple example will now be introduced and referenced throughout the disclosure. This example is illustrative and not limiting and is provided purely for explanatory purposes.

Figure 1B:
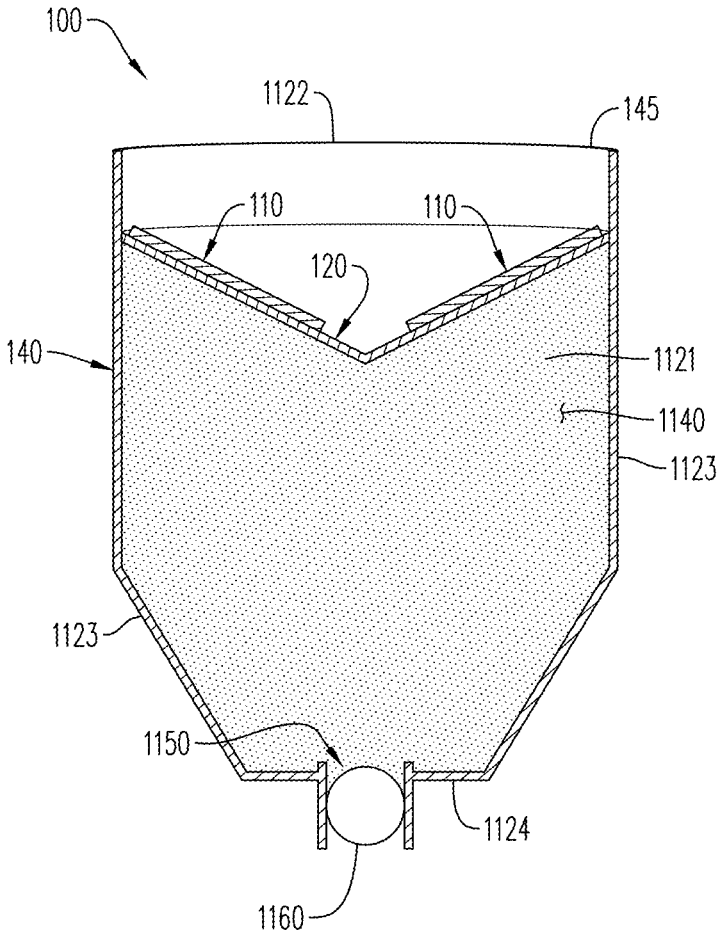
FIG. 1B is a cross-sectional view of a shaped charge including a shaped charge inlay, in accordance with an exemplary embodiment.
Figure 2:
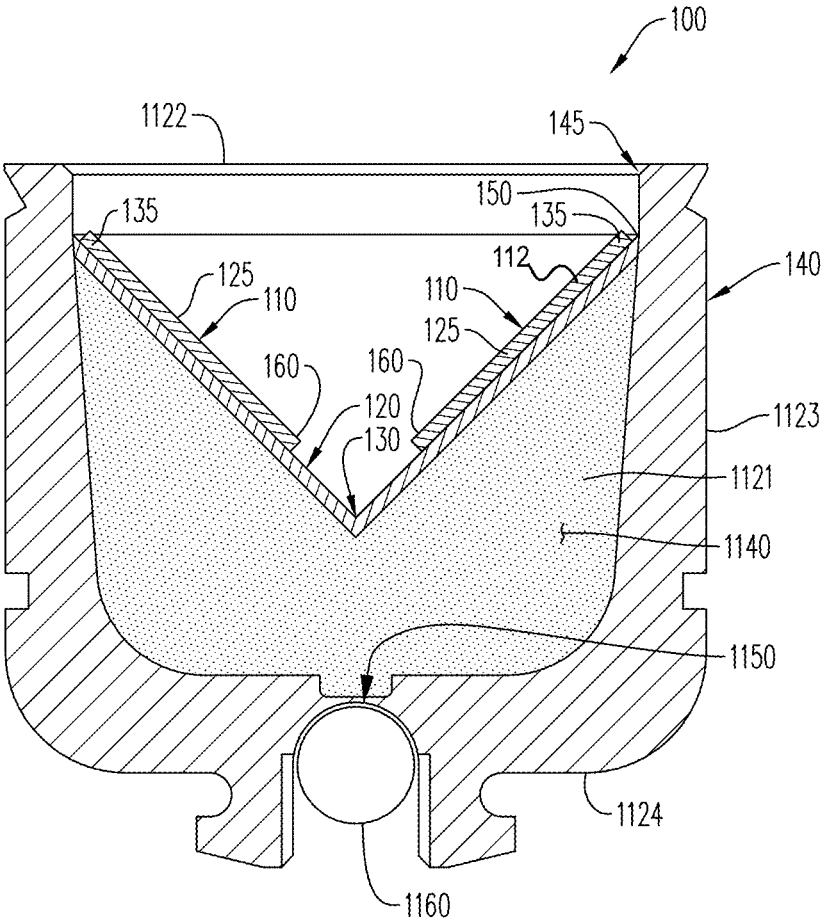
FIG. 2 is a cross-sectional view of a shaped charge including a shaped charge inlay, in accordance with an exemplary embodiment.

With reference to FIGS. 1A, 1B and 2, a typical shaped charge 100 is shown. The shaped charge 100 includes a case 140 that defines an overall geometry of the shaped charge 100. The case 140 may be formed from machinable steel, aluminum, stainless-steel, copper, zinc, and the like. According to an aspect and as illustrated in FIG. 1, the case 140 is substantially frustoconical.

The shaped charge 100 includes a shaped charge inlay 110, in accordance with an embodiment. The shaped charge inlay 110 may be formed from a rigid material or semi-rigid material such as a plastic material or polymer such as polyamide, a metal, a combination of such materials, or other materials consistent with this disclosure. The shaped charge inlay 110 may be formed from a rubber material. According to an aspect, the shaped charge inlay 110 includes one or more fingers 112 including an upper edge 135 and a distal edge 160 opposite the upper edge 135. The fingers 112 of the inlay 110 may further include a body 125 that extends between the upper edge 135 and the distal edge 160. The distal edge 160 may inwardly taper away from the upper edge 135, such that the body 125 has a triangular shape. According to an aspect, the shaped charge inlay 110 is attached or otherwise secured to the existing liner 120 and/or the shaped charge casing 140 by a number of techniques, as described hereinabove.

Figure 2A:
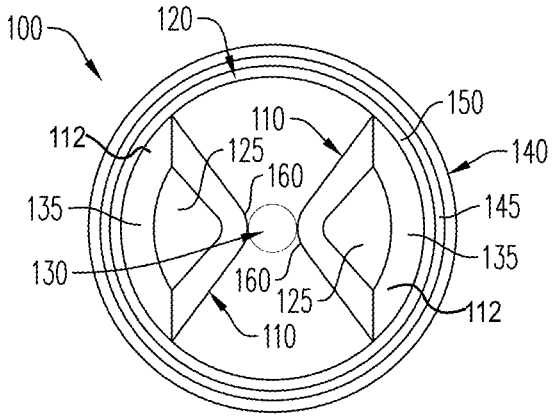
FIG. 2A is a top view of a shaped charge including a shaped charge inlay, in accordance with an exemplary embodiment.

As illustrated in the exemplary embodiment of FIG. 1A, the shaped charge inlay 110 may extend from an upper edge 150 of the liner 120 towards a center or apex 130 of the liner 120. In some embodiments, the shaped charge inlay 110 does not overlap the apex 130. As illustrated in FIGS. 1A and 2A, the distal edge 160 of the inlay 110 may be oriented towards the apex 130 of the existing liner 120. In some embodiments, the upper edge 135 is larger than the distal edge/tapered distal edge 160, and both edges 135, 160 may generally define a shape of the body 125 of the inlay 110. As illustrated in FIGS. 1A and 2A-2C and according to an aspect, the shaped charge inlay 110 inlay may be triangularly-shaped. It is contemplated, however, that the shape of the shaped charge inlay 110 may be of any desired shape that is consistent with this disclosure.

Figure 13A:
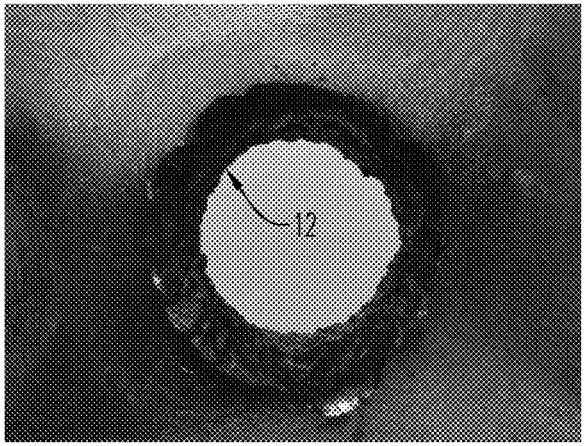
FIG. 13A (PRIOR ART)
FIG. 13A illustrates a typical perforation hole formed by a conical shaped charge, without a shaped charge inlay according to the prior art.

During detonation of the shaped charge 100, the shaped charge inlay 110 may disrupt/disturb the collapse of the existing liner 120 (described in further detail hereinbelow) in at least one direction. Such a disruption may lead to the creation of, e.g., a slot-shaped perforation 1210 (see FIG. 13B) by the liner 120 taking a resulting atypical shape (e.g., a rectangular or slotted shape) during discharge of the liner 120 from the shaped charge case 140. The atypical perforation 1200 differs from a typical perforation 12, such as, a typical round shaped perforation formed by conical shaped charges (FIG. 13A).

As illustrated in FIGS. 1B and 2, the case 140 of the shaped charge 100 within which the shaped charge inlay 110 is positioned includes a back wall 1124, an open front portion 1122, and a sidewall 1123 that extends between the back wall 1124 and the open front portion 1122. The case 140 may further include an edge 145 that circumscribes an opening of the case 140 and is defined based on a circumference of the case 140. The back wall 1124 and sidewall 1123 define a hollow interior 1121 of the case 140. An explosive load 1140 is disposed within the hollow interior 1121 of the case 140, and is positioned so that it abuts the back wall 1124 and at least a portion of the side wall 1123 adjacent the back wall 1124.

A liner 120 is disposed atop the explosive load 1140, so that the explosive load 1140 is encased within the hollow interior 1121. The liner 120 may include any shaped, such as, a conical shape, a tulip shape, a bell shape, and the like. The liner 120 may be formed from a variety of various powdered metallic and non-metallic materials and/or powdered metal alloys, and binders. According to an aspect, the liner 120 is formed from copper, pressed to form the desired liner shape. In certain exemplary embodiments, the liner material(s) may include an inert material, where an inert material may be a material that does not participate in a chemical reaction, including an exothermic chemical reaction, with the liner 120 and/or other components of the shaped charge including elements created as a result of a detonation of the shaped charge. In the same or other embodiments, the liner material may include an energetic material, where an energetic material may be a material that is capable of a chemical reaction, including an exothermic chemical reaction, with one or more components of the liner 120, the inlay 110 and/or other components of the shaped charge including elements created as a result of a detonation of the shaped charge.

The shaped charge inlay 110 is disposed above the liner 120. In an embodiment, the shaped charge inlay 110 is affixed to at least a portion of the liner 120. According to an aspect, and as illustrated in FIG. 2, the shaped charge inlay 110 is coupled or otherwise affixed to an upper edge 150 of the liner 120. The inlay 110 may be coupled to the case 140 and/or the liner 120 by, for example and without limitation, adhesives, or may be rigidly secured in place within the shaped charge case 140 by friction fit, clamps, adhesives, clips, welding, or other known techniques.

According to an aspect, a detonating device 1160, such as a detonating cord, may be in contact or communication with the explosive load 1140 through an initiation point 1150 formed in the back wall 1124, to initiate detonation of the shaped charge 100. According to an aspect, the initiation point 1150 may be an aperture (FIGS. 1A and 1B) or depression (FIG. 2) formed in the back wall 1124 of the case 140. When the detonating cord is initiated, a detonation wave (or initiation energy produced upon initiation of the detonating cord) travels along the detonating cord to the initiation point, and ultimately to the explosive load 1140. The explosive load 1140 detonates and creates a detonation wave, which generally causes the liner 120 and the inlay 110 to collapse and be ejected from the case 140, thereby producing a forward moving perforating jet. The inlay impacts the shape of the perforating jet in a manner that produces an atypical perforation hole 1200 geometry in a target. Such atypical perforation hole geometries may be a slot/rectangular hole formed by a conical shaped charge, rather than the typical circular perforation hole geometry (FIG. 13A) formed when conical shaped charges are initiated without an inlay.

Figure 2B:
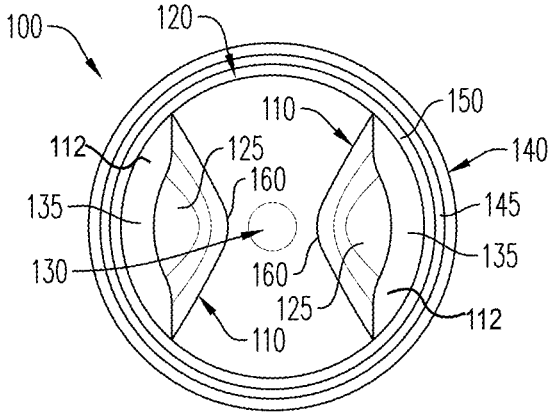
FIG. 2B is a top view of a shaped charge including a shaped charge inlay, in accordance with another exemplary embodiment.
Figure 2C:
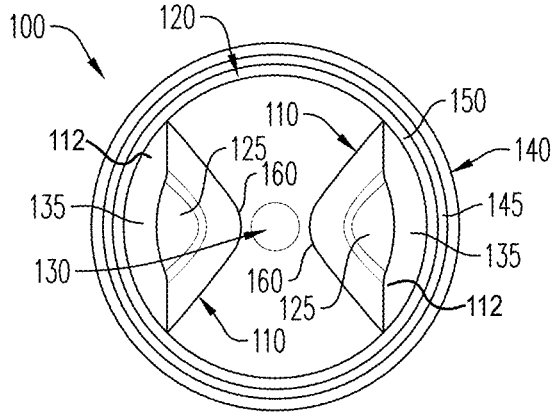
FIG. 2C is a top view of a shaped charge including a shaped charge inlay, in accordance with another exemplary embodiment.
Figure 3:
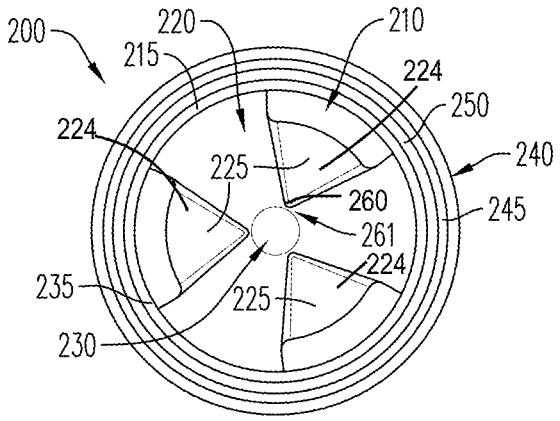
FIG. 3 is a top view of a shaped charge including a shaped charge inlay including continuous ring, in accordance with another exemplary embodiment.
Figure 4:
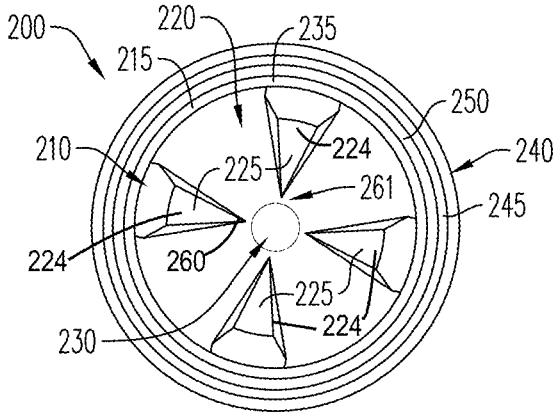
FIG. 4 is a top view of a shaped charge including a shaped charge inlay including a continuous ring, in accordance with another exemplary embodiment.
Figure 5:
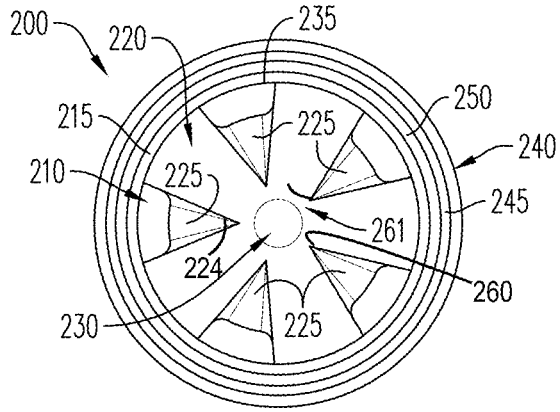
FIG. 5 is a top view of a shaped charge including a shaped charge inlay including a continuous ring, in accordance with another exemplary embodiment.
Figure 6A:
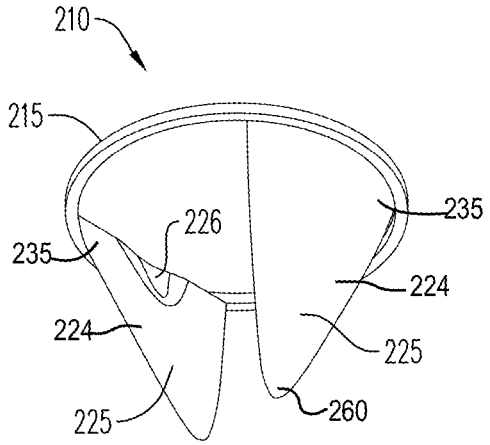
FIG. 6A is a bottom up, perspective view of a shaped charge inlay including a continuous ring, in accordance with an exemplary embodiment.
Figure 6B:
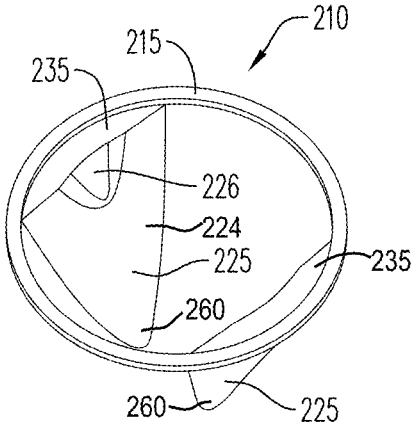
FIG. 6B is a top down, perspective view of the shaped charge inlay of FIG. 6A.
Figure 7A:
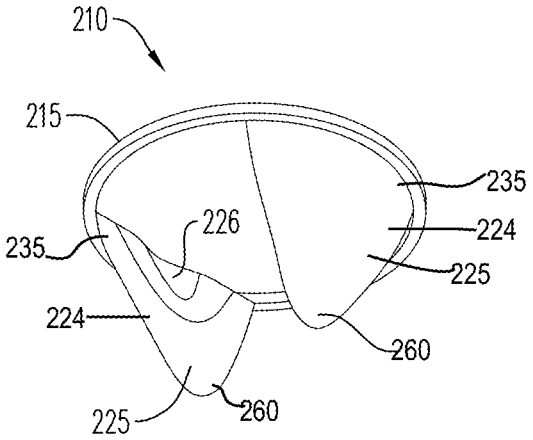
FIG. 7A is a bottom up, perspective view of a shaped charge inlay including a continuous ring, in accordance with another exemplary embodiment.
Figure 7B:
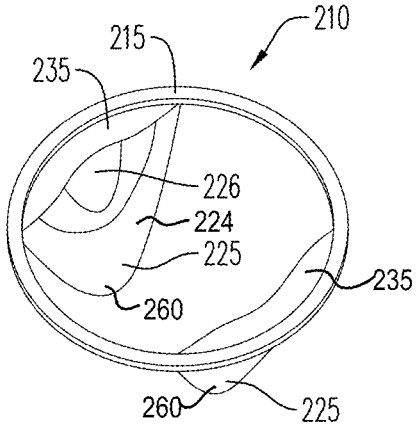
FIG. 7B is a top down, perspective view of the shaped charge inlay of FIG. 7A.

FIGS. 2A, 2B and 2C show additional exemplary embodiments of the shaped charge inlay 110. The shaped charge 100 including the shaped charge inlay 110 is illustrated from a top view. The shaped charge 100 includes the shaped charge casing 140 and the liner 120. One or more shaped charge inlays 110 may be inserted into the shaped charge 100 (e.g., as illustrated, two shaped charge inlays 110 are inserted in FIGS. 2A-2C). For purposes of convenience, and not limitation, the general characteristics of the shaped charge inlay 110 are described above with reference to FIGS. 1A, 1B and 2, and are not repeated here. As shown in FIGS. 2A, 2B and 2C, and without limitation, the shaped charge inlay 110 may take a variety of shapes and sizes and thereby cover different amounts and portions of a liner 120. For example, the exemplary shaped charge inlay 110 shown in FIG. 2B does not extend as far towards an apex 130 of the liner 120 as compared to the shaped charge inlay 110 shown in FIG. 2A. Similarly, the exemplary shaped charge inlay 110 shown in FIG. 2C also does not extend as far towards the apex 130 of the liner 120, and the shaped charge inlay 110 in FIG. 2C has a narrower profile (or covers less surface area of the liner 120) than the shaped charge inlays 110 of each of FIG. 2A and FIG. 2B.

Now referring to FIGS. 3-5 and FIG. 11, additional exemplary embodiments of shaped charges 200 and respective shaped charge inlays 210 are illustrated. Each shaped charge 200 may include a liner 220 positioned in a shaped charge case 240. The shaped charge liner 220 and case 240 are similar to the shaped charge liner 120 and case 140 described hereinabove with respect to FIGS. 1A, 1B, 2 and 2A-2C. Thus, for purposes of convenience, and not limitation, the general characteristics of the shaped charge liner 120 and case 140 are not repeated here.

Figure 11:
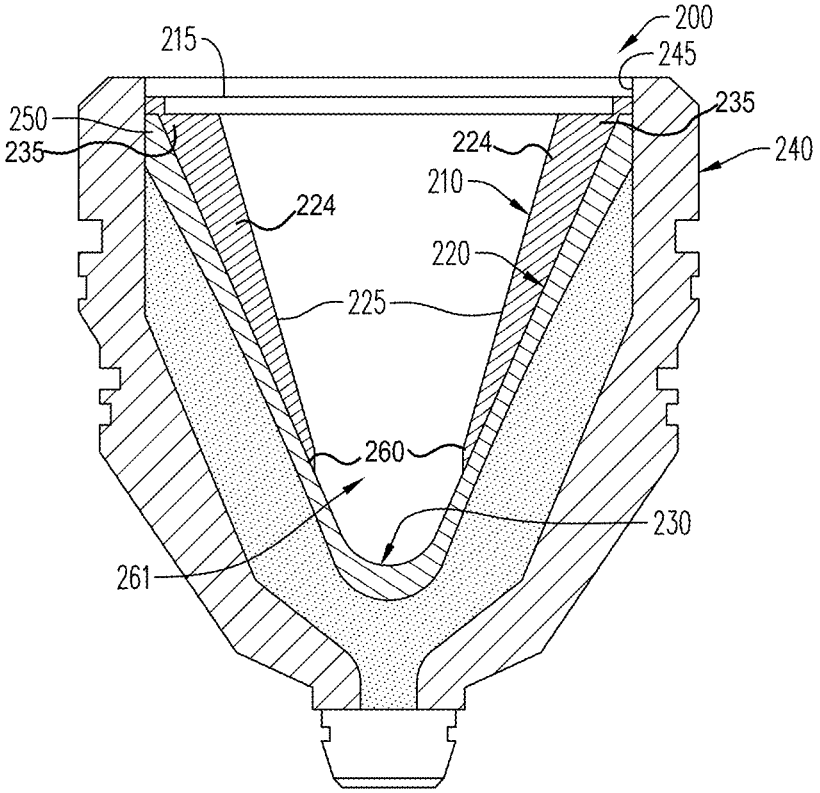
FIG. 11 is a cross-sectional view of a shaped charge including a shaped charge inlay with a continuous ring and fingers extending from the ring, in accordance with an exemplary embodiment.
Figure 12:
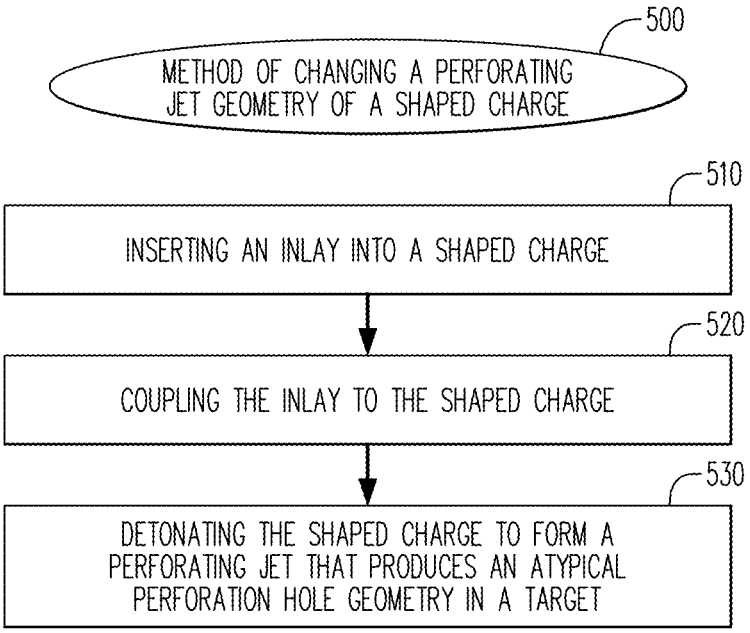
FIG. 12 is a flow chart illustrating a method of changing a perforating jet geometry of a shaped charge, using a shaped charge inlay, in accordance with an exemplary embodiment.

According to an aspect, the shaped charge inlay 210 is composed of a rigid or semi-rigid material. Such materials may be inert and may include plastics, rubbers or metals. The shaped charge inlay 210 may include a ring/continuous ring 215. According to an aspect, the case 240 of the shaped charge includes an edge 245, and the continuous ring 215 may extend inwardly from the edge 245 of the case 240 (see, for example, FIG. 11). According to an aspect and as illustrated in FIG. 11, the continuous ring 215 of the shaped charge inlay 210 is configured for being latched, clamped or otherwise secured to the edge 245 of the shaped charge case 240. It is also contemplated that the continuous ring 215 may be rigidly secured above the liner 220, or to the upper edge 250 of the liner 220, within the shaped charge 200 by a friction fit or with an adhesive.

A plurality of fingers/protrusions/segments/spikes 225 may extend from the continuous ring 215 in a generally vertical direction. According to an aspect, each finger 225 includes an upper edge 235, a distal edge 260 and a body 224 extending between the upper edge 235 and the distal edge 260. The distal edge 260 inwardly tapers away from the upper edge 235, such that the body 224 has a substantially triangular shape. The distal edge 260 of the fingers 225 are arranged in a manner that forms an open apex 261 of the inlay 210 when positioned atop the shaped charge liner. The open apex 261 is the area of the fingers 225 that is furthest away from the continuous ring 215, and is generally an open area over the apex 230 of the liner 220. The continuous ring 215 couples the plurality of fingers 225 and maintains each finger in a spaced apart configuration from each other, such that when the inlay 210 is inserted into a shaped charge case 240, the continuous ring 215 circumscribes an inner circumference of the shaped charge case 240 and maintains the position of the fingers 225 along the liner 220. To be sure, the fingers 225 may also be secured to the liner 220 by adhesives, or other mechanisms, to help ensure that the contemplated transformation of the perforating jet is achieved.

In the aforementioned exemplary embodiments and other embodiments, the number and shape of fingers on a shaped charge inlay define a shape or geometry of a perforating jet and/or perforation that is produced by the shaped charge including such an inlay upon detonation. The shape and quantity of the fingers 225 of the shaped charge inlay 210 may be based on a particular requirement of the application in which they are to be used, such as the desired shape and size of the atypical perforation hole geometry. The number of fingers 225 may include 3, 4, 5, 6, or more. In certain embodiments, multiple shaped charge inlays and/or fingers of a shaped charge inlay according to the disclosure may be equally spaced around a circumference of the shaped charge and existing liner. Each finger 225, for example, may alter/transform the perforating jet to create the atypical perforation hole geometry.

Figure 13B:
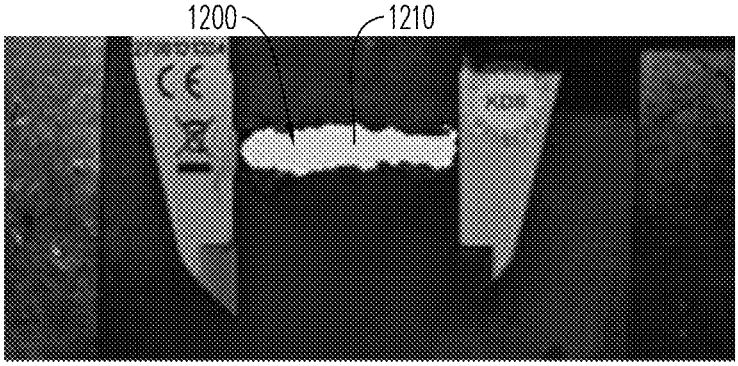
FIG. 13B illustrates an atypical perforation hole formed by a conical shaped charge including a shaped charge inlay, in accordance with an exemplary embodiment.

FIGS. 6A-6B and 7A-7B illustrate the shaped charge inlay 210 including two fingers 225. The fingers 225 are spaced 180 degrees apart from each other. Upon detonating of the shaped charge, such as a conical shaped charge, in which the two finger inlay is positioned, the resulting atypical perforation hole geometry 1200 is a slot/rectangular perforation hole 1210, as illustrated in FIG. 13B. In the exemplary embodiments shown in FIGS. 6A-6B and 7A-7B, each of the plurality of fingers 225 comprise an indentation/indented area 226. The indented area 226 may extend from the upper edge 235 towards the distal edge 260. According to an aspect, the indented area 226 does not extend to the distal edge 226 of the finger 225. The indented area 226 facilitates at least a partial disruption of the perforating jet in order to form the desired atypical perforation hole geometry. In some embodiments, the two fingers 225 may be spaced 180 degrees apart from each other on the continuous ring 215 where each finger spans between 20 to 160 degrees of the circumference of the continuous ring 215.

Figure 8A:
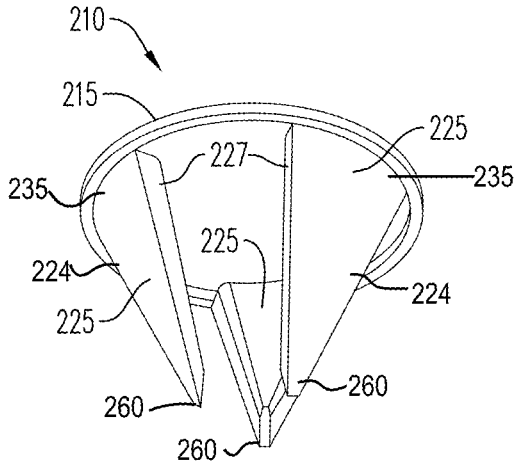
FIG. 8A is a bottom up, perspective view of a shaped charge inlay including a continuous ring, in accordance with another exemplary embodiment.
Figure 8B:
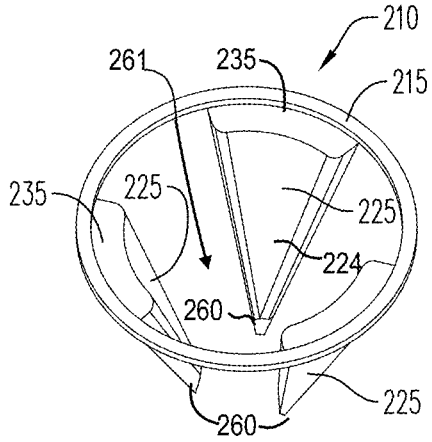
FIG. 8B is a top down, perspective view of the shaped charge inlay of FIG. 8A.
Figure 14:
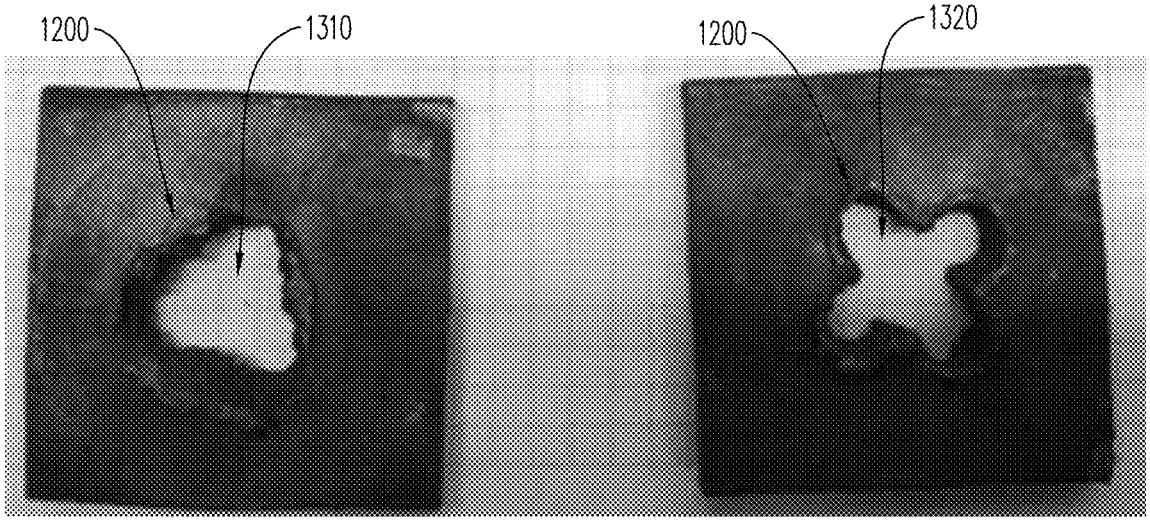
FIG. 14 illustrates atypical perforation holes formed using a shaped charge inlay, in accordance with an exemplary embodiment.

FIGS. 8A-8B illustrate the shaped charge inlay 210 including three fingers 225. The three fingers 225 are spaced 60 degrees apart from each other. According to an aspect, each finger 225 spans 60 degrees of a circumference of the continuous ring 215 of the inlay 210. Upon detonating of the shaped charge 200, such as a conical shaped charge, in which the three finger inlay is positioned, the resulting atypical perforation hole geometry 1200 is a triangularly-shaped perforation hole 1310, as illustrated in FIG. 14. In the exemplary embodiments shown in FIGS. 8A-8B, each of the plurality of fingers 225 includes a beveled edge 227. The beveled edge 227 may enhance the strength and/or the rigidity of the fingers 225. In some embodiments, the three fingers 225 may be spaced 60 degrees apart from each other on the continuous ring 215 where each finger spans between 20 to 100 degrees of the circumference of the continuous ring 215.

Figure 9A:
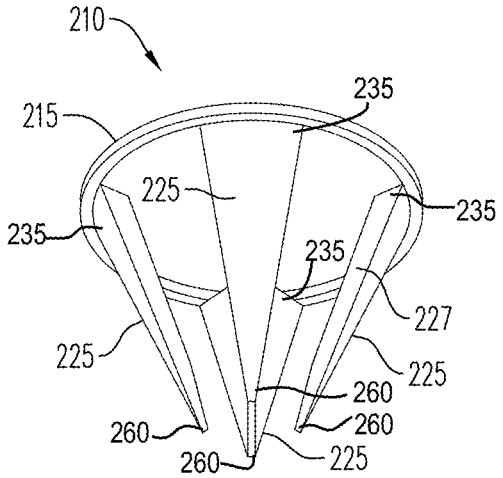
FIG. 9A is a bottom up, perspective view of a shaped charge inlay including a continuous ring, in accordance with another exemplary embodiment.
Figure 9B:
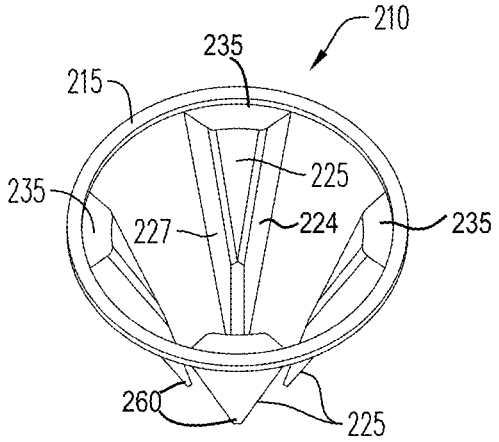
FIG. 9B is a top down, perspective view of the shaped charge inlay of FIG. 9A.

FIGS. 9A-9B illustrate the shaped charge inlay 210 including four fingers 225. The four fingers 225 are spaced 45 degrees apart from each other. In this embodiment, each finger 225 spans 45 degrees of the circumference of the continuous ring 215. Detonation of the shaped charge 200 (e.g., a conical shaped charge) including the four finger inlay forms a perforating jet that creates an X-shaped perforation hole 1320, as illustrated in FIG. 14. According to an aspect, the fingers 225 may include the aforementioned beveled edge 227. In some embodiments, the four fingers 225 may be spaced 45 degrees apart from each other on the continuous ring 215 where each finger spans between 15 to 75 degrees of the circumference of the continuous ring 215.

Figure 10A:
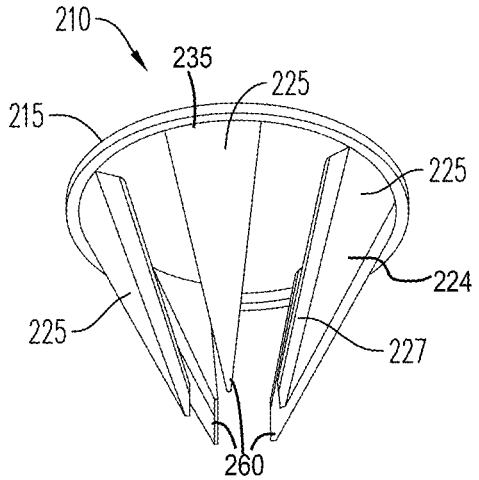
FIG. 10A is a bottom up, perspective view of a shaped charge inlay including a continuous ring, in accordance with another exemplary embodiment.
Figure 10B:
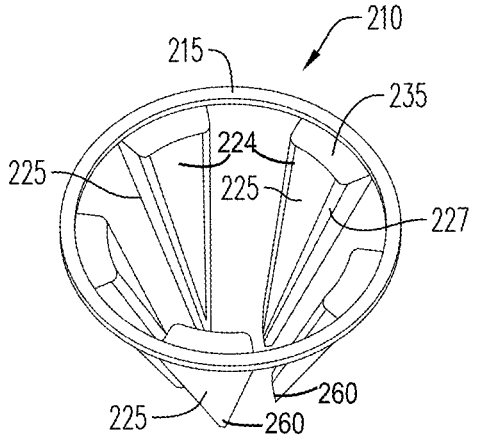
FIG. 10B is a top down, perspective view of the shaped charge inlay of FIG. 10A.
Figure 15:
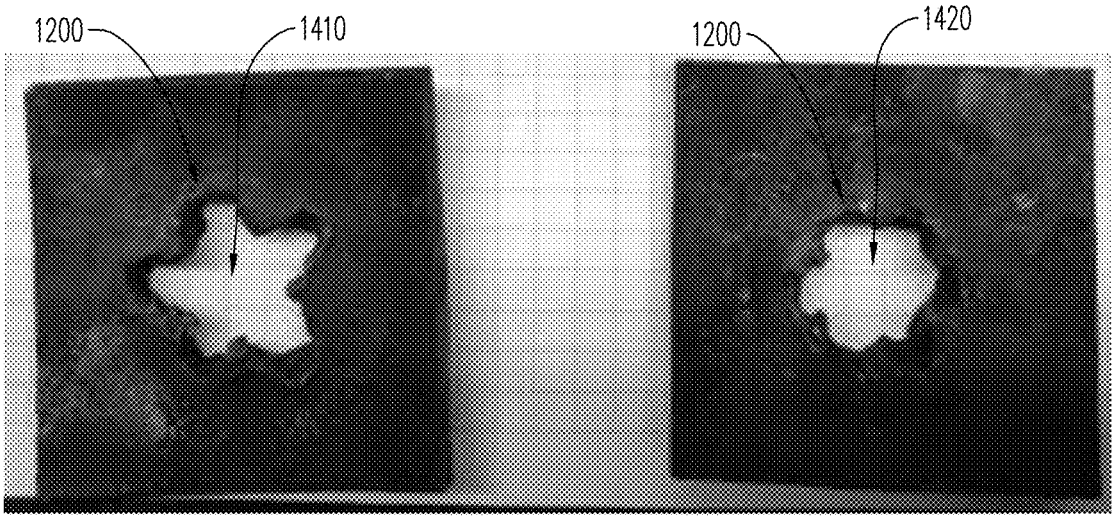
FIG. 15 illustrates atypical perforation holes formed using a shaped charge inlay, in accordance with an exemplary embodiment.

FIGS. 10A-10B illustrate the shaped charge inlay 210 including five fingers 225. The five fingers 225 are spaced about 36 degrees apart from each other. In this embodiment, each finger 225 spans 36 degrees of the circumference of the continuous ring 215. Detonation of the shaped charge 200 (e.g., a conical shaped charge) including the five finger inlay forms a perforating jet that creates a star-shaped perforation hole 1410, as illustrated in FIG. 15. According to an aspect, the finger 225 may include the aforementioned beveled edge 227. In some embodiments, the five fingers 225 may be spaced 36 degrees apart from each other on the continuous ring 215 where each finger spans between 10 to 60 degrees of the circumference of the continuous ring 215.

FIG. 15 further illustrates a daisy-shaped perforation hole 1420, which may be formed from a shaped charge inlay 210 including at least six fingers 225. The fingers 225 may include beveled edges 227, such as those illustrated in FIGS. 8A-8B, 9A-9B and 10A-10B, to add strength and rigidity to the fingers 225.

Embodiments of the disclosure further relate to a method 500 of changing a perforating jet geometry of a shaped charge. The method 500 includes using one or more shaped charge inlays 110/210 in conjunction with a shaped charge 100/200. As illustrated in the flow chart of FIG. 5, a shaped charge inlay may be inserted/placed 510 into a shaped charge that includes an existing liner. The liner may be of any standard liner shape/configuration, such as, conical, tulip, bell, or the like. The shaped charge inlay may be coupled or otherwise coupled 520 to the shaped charge. The shaped charge inlay may be affixed to the existing liner (as previously discussed) by, for example and without limitation, adhesives, or may be rigidly secured in place within a shaped charge case by friction fit, clamps, adhesives, clips, welding, or other known techniques. The shaped charge may thereafter be installed within a carrier of a perforating gun. The shaped charge may be detonated 530 while positioned in a wellbore. During detonation, the shaped charge inlay may disturb a collapse of the liner, thereby causing the liner to create a perforation and/or perforating jet that defines a different geometry than a typical geometry (see, for instance, FIG. 13A, illustrating the geometry formed by a conical shaped charge) that would be created by detonating the shaped charge without the shaped charge inlay. For example, the shaped charge inlay may create a slot-shaped perforation even though the shaped charge is a conical shaped charge. FIGS. 13B-15 show exemplary atypical perforations 1200, such as a slot-shaped perforation 1210 (FIG. 13B), a triangle-shape perforation 1310 (FIG. 14) and a star-shaped perforation 1410 (FIG. 15) created by a conical shaped charge, using the shaped charge inlays 110/210 described hereinabove.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A shaped charge inlay to cover a portion of an inner surface of a conical shaped charge liner, the shaped charge inlay comprising:

a continuous ring comprising two or more fingers extending from the continuous ring, each finger being spaced apart from each other and comprising an upper edge and a distal edge, the upper edge depending from the continuous ring and the distal edge being spaced apart from the upper edge, wherein the fingers are shaped to adapt to a shape of the shaped charge liner, the distal edges of the fingers are spaced apart from each other, such that the inlay comprises an open apex, at least one of the continuous ring and the upper edge of the fingers is configured to be secured to an upper edge of the shaped charge liner, and wherein the shaped charge inlay is configured to transform a perforating jet to create a slotted perforation hole geometry.

2. The shaped charge inlay of claim 1, wherein at least one of the continuous ring and the fingers are affixed to the shaped charge liner by an adhesive.

3. The shaped charge inlay of claim 1, wherein at least one of the continuous ring and the fingers are affixed to the shaped charge liner by a friction fit.

4. The shaped charge inlay of claim 1, wherein the continuous ring is configured for being coupled to an upper edge of the shaped charge liner, the upper edge of the liner being spaced apart from an apex of the liner.

5. The shaped charge inlay of claim 1, wherein the shaped charge inlay is formed from an inert material and is comprised of a rigid or semi-rigid material that includes at least one of a plastic material, a polymer and a metal.

6. The shaped charge inlay of claim 1, wherein the fingers comprise one of a triangle shape and a trapezoid shape.

7. The shaped charge inlay of claim 1, wherein each finger comprises an indentation extending from the upper edge towards the distal edge.

8. The shaped charge inlay of claim 7, wherein the indentation does not extend to the distal edge of the finger.

9. The shaped charge inlay of claim 1, wherein the fingers comprise:

two fingers spaced apart from each other on the continuous ring, each finger spanning 10 degrees to 160 degrees of a circumference of the continuous ring.

10. A shaped charge inlay comprising:

a continuous ring; and two or more fingers extending from the continuous ring, wherein the fingers comprise an upper edge extending from the continuous ring and a distal edge spaced apart from the upper edge, wherein the distal edges of the fingers are spaced apart from each other such that the inlay comprises an open apex, wherein at least one of the continuous ring and the upper edge is configured for being coupled to an upper edge of a conical shaped charge liner, the fingers are contoured to adapt to a shape of the shaped charge liner, and the shaped charge inlay is configured to transform a perforating jet to create a slotted perforation hole geometry.

11. The shaped charge inlay of claim 10, wherein at least one of the continuous ring and the fingers are affixed to the shaped charge liner by an adhesive or by a friction fit.

12. The shaped charge inlay of claim 10, wherein the shaped charge inlay is formed from an inert material that includes at least one of a plastic material, a polymer and a metal.

13. The shaped charge inlay of claim 10, wherein the fingers cover a portion of the shaped charge liner to define a shape for transforming a perforating jet produced by detonating the shaped charge to produce the slotted perforation hole geometry.

14. The shaped charge inlay of claim 10, wherein the fingers comprise:

two fingers spaced apart from each other on the continuous ring, each finger spanning 10 degrees to 160 degrees of a circumference of the continuous ring.

15. A method of changing a perforating jet geometry of a shaped charge, comprising:

inserting a shaped charge inlay into a shaped charge comprising an explosive load and a conical shaped charge liner adjacent the explosive load, wherein the shaped charge inlay comprises a continuous ring and two or more fingers extending from the continuous ring, wherein each of the fingers comprise an upper edge depending from the continuous ring and a distal edge spaced apart from the upper edge, wherein the distal edges are spaced apart from each other such that the inlay comprises an open apex, and the fingers are contoured to adapt to a shape of the liner, and at least one of the continuous ring and the upper edge of the fingers is coupled to the upper edge of the conical shaped charge liner; and detonating the shaped charge to form a perforating jet and transform the perforating jet to produce a slotted perforation hole geometry in a target.

16. The method of claim 15, wherein at least one of the continuous ring and the fingers are affixed to the liner by an adhesive or by a friction fit.

17. The method of claim 15, wherein the shaped charge inlay is formed from an inert material that includes at least one of a plastic material, a polymer and a metal.

* * * * *